United States Patent [19]

Izumi

[11] Patent Number: 4,508,445

[45] Date of Patent: Apr. 2, 1985

[54] SHEET CONVEYING DEVICE FOR A COPYING MACHINE

[75] Inventor: Hirotaka Izumi, Kanagawa, Japan

[73] Assignee: Fuji Xerox Co., Ltd., Tokyo, Japan

[21] Appl. No.: 528,013

[22] Filed: Aug. 31, 1983

[30] Foreign Application Priority Data

Aug. 31, 1982 [JP] Japan ..... 57-151183

[51] Int. Cl.[3] ..... G03G 15/00

[52] U.S. Cl. ..... 355/3 SH

[58] Field of Search ..... 355/3 SH, 14 SH; 271/228, 251, 254, 9, 3.1

[56] References Cited

U.S. PATENT DOCUMENTS

| | | | |
|---|---|---|---|
| 4,272,180 | 6/1981 | Satomi et al. | 355/14 SH X |
| 4,294,535 | 10/1981 | Ariyama et al. | 355/14 SH |
| 4,330,197 | 5/1982 | Smith et al. | 355/14 SH |
| 4,416,534 | 11/1983 | Kluger | 355/3 SH X |
| 4,464,042 | 8/1984 | Omori et al. | 355/3 SH |

*Primary Examiner*—A. C. Prescott

*Attorney, Agent, or Firm*—Sughrue, Mion, Zinn, Macpeak and Seas

[57] ABSTRACT

In a copying machine having a flat chute for guiding a sheet of copy paper to a fixing section comprised of a heating roll and a pressure roll, the opposite edges of the flat chute adjacent the heating roll are turned downwardly to prevent the middle portion of a sheet being conveyed thereon from floating off the central portion of the chute.

2 Claims, 5 Drawing Figures

SHEET CONVEYING DEVICE FOR A COPYING MACHINE

BACKGROUND OF THE INVENTION

The present invention is direction to a sheet conveying device for a copying machine and more specifically to the configuration of the chute for guiding a sheet from the image transfer station to a fixing station.

In conventional copying machines, such as that shown in FIG. 1, a supply tray 1 holds a supply of sheets which are fed into the machine one at a time by means of a sheet feeding roll 2. A photo-sensitive drum 4 is provided for transferring a toner image onto the copy sheet in the transfer section 3 in the conventional well known manner. The feed direction of the copy sheet is then changed by passage around the roll 5 between the roll 5 and a pinch roll 6. The sheet is then forwarded along the chute 9 to the fixing section which includes a heating roll 7 and a pressure roll 8. The sheet is then discharged from the copying machine by means of discharge roll 10.

The chute 9 is provided with a substantially flat conveying surface for the copy sheet with the discharge end 9*a* thereof being aligned with the nip region between the heating roll 7 and the pressure roll 8 for smoothly guiding the copy sheet between the rolls 7 and 8 without creasing the sheet. A heat shield plate 8 is located adjacent the heating roll 7 and is disposed in close proximity to the discharge end 9*a* of the chute 9. After the trailing edge of a sheet moving on the chute 9 moves out of engagement with the rolls 5 and 6, the sole feeding means for the sheet are the rolls 7 and 8. Thus, there is a tendency for the trailing end of the copying sheet to be lifted from the surface of the chute 9 so as to be brought into contact with the heat shield plate 11 which frequently results in the smudging of the toner on the copy sheet. While the roll 8 has a uniform cylindrical surface, the roll 7 increases in diameter from the center towards both ends thereof. Accordingly, the central portion of the sheet tends to be lifted to cause a floating action of the trailing edge of the sheet off the surface of the chute 9.

SUMMARY OF THE INVENTION

The present invention provides a new and improved sheet conveying device for a copying machine which overcomes the aforementioned problem associated with conventional copying machines in a simple and economical manner.

The present invention provides a new and improved sheet conveying device for a copying machine wherein the opposite edges of the chute which guide a copy sheet from a transfer station to a fixing station are turned downwardly adjacent the heating roll and pressure roll at the transfer station to prevent a copy sheet from floating off the surface of a chute into contact with a heat shield adjacent the heating roll.

The foregoing and other objects, features and advantages of the invention will be apparent from the following more particular description of preferred embodiments of the invention as illustrated in the accompanying drawings.

DETAILED DESCRIPTION OF THE INVENTION

Figure 1:
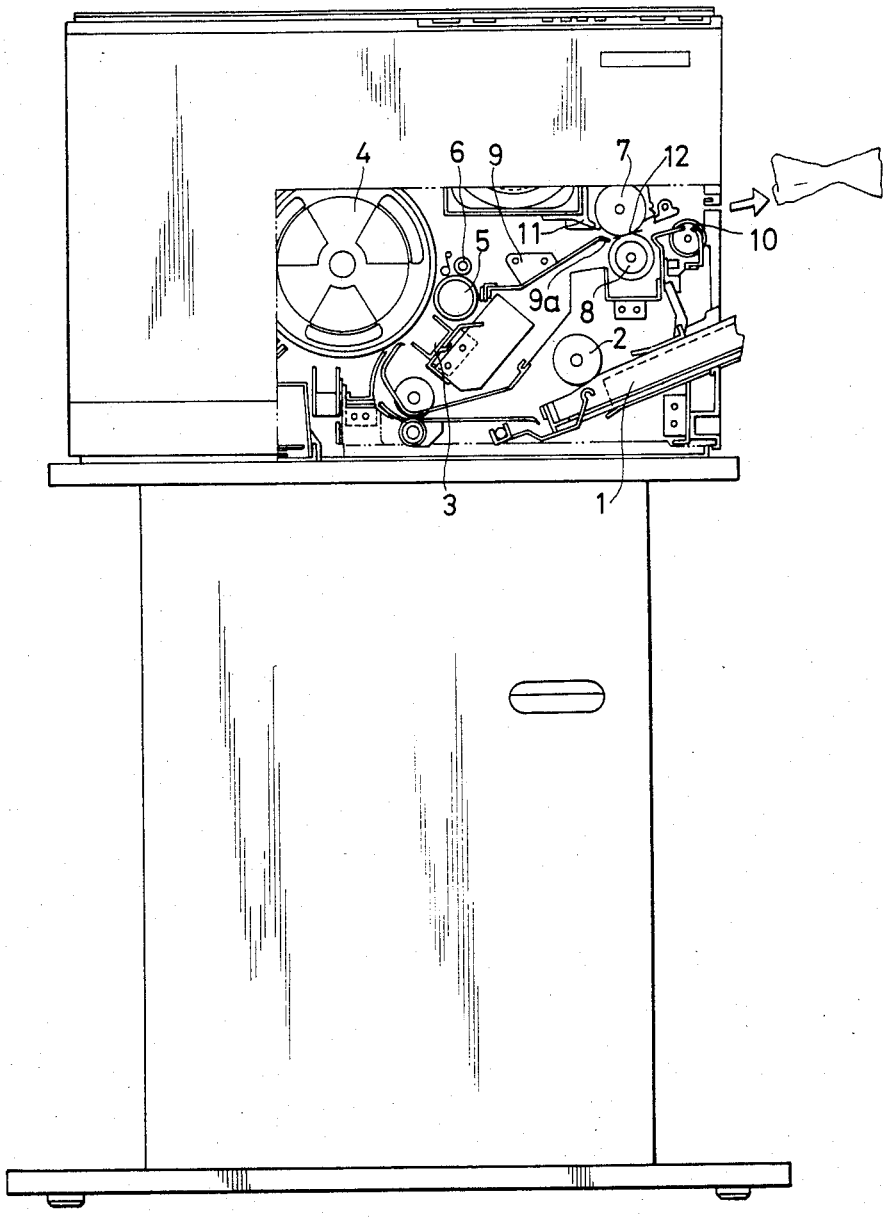
FIG. 1 is a schematic side elevation view of a conventional copying machine showing the arrangement for guiding a copy sheet through the machine.
Figure 2:
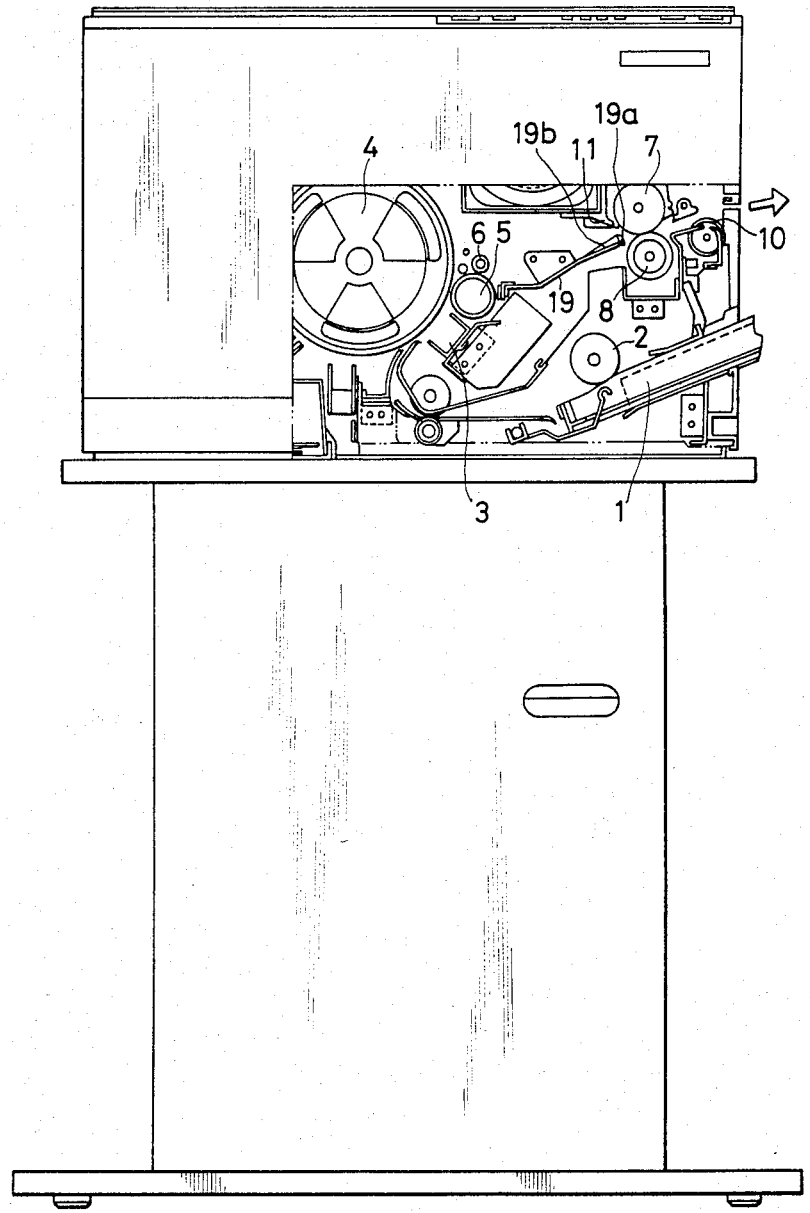
FIG. 2 is a schematic side elevation view of a copying machine according to the present invention showing the arrangement for guiding a copy sheet through the machine.

The copying machine as shown in FIG. 2 is substantially identical to the copying machine shown in FIG. 1 with the exception of the guide chute 19 which has a different configuration from the guide chute 9 shown in FIG. 1. All of the other parts are identified by the same reference numerals.

According to the present invention, the opposite edges 19*b* of the guide chute 19 are turned downwardly relative to the main flat sheet feeding surface of the chute 19. The downturned edge portions 19*b* are disposed adjacent the edge 19*a* of the chute 19 which is disposed adjacent the heating roll 7. The downturned edges 19*b* are bent downwardly approximately 3 mm. Thus, the tendency of the middle portion of the copy sheet to float off the surface of the chute 19 while the sheet is being conveyed solely by the heating roll 7 and the pressure roll 8 is negated since the opposite edges of the sheet are allowed to move below the surface of the chute 19, thereby maintaining the middle portion of the sheet in engagement with the chute adjacent the edge portion 19*a*. Thus, the middle portion of the sheet will not contact the heat shield 11 which is disposed in close proximity to the end 19*a* of the chute.

Figure 3A:
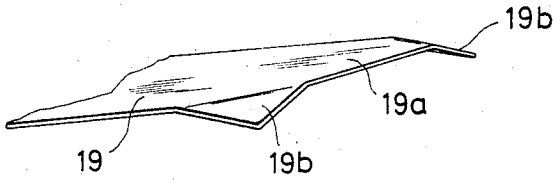
FIG. 3(A) is a partial perspective view of the end of a sheet transfer chute according to the present invention.
Figure 3B:
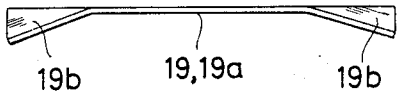
FIG. 3(B) is an end view of the chute shown in FIG. 3(A).
Figure 4:
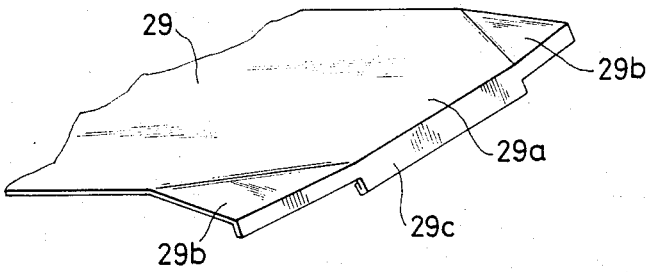
FIG. 4 is a partial perspective view showing the end of a modified sheet guiding chute.

The embodiment of the present invention as shown in FIG. 4 is similar to that disclosed in FIG. 3 inasmuch as the opposite end edges 29*b* of the chute 29 are turned downwardly adjacent the end portion 29*a*. Additionaly, the end portion 29*a* is provided with a reversely bent portion 29*c* which will prevent scratching of the heating roll 7 by the end edge of the chute during removal of the chute and pressure roller in order to remove a jammed sheet from the machine.

In summary, it is clear from the foregoing description of the copy sheet conveying device according to the present invention that the opposite side edges thereof adjacent the front end portion of the chute bend downwardly to prevent the copy sheet from floating off the chute. In this manner, the copy sheet is prevented from being smudged by engagement with adjacent elements prior to being fixed.

While the invention has been particularly shown and described with respect to preferred embodiments thereof, it will be understood by those in the art that the foregoing and other changes in form and details may be made therein without departing from the spirit and scope of the invention.

What is claimed is:

1. A sheet conveying device for a copying machine having a toner image transfer section and a fixing section comprising a substantially flat sheet guide chute adapted to be disposed between said toner image transfer section and said fixing section with the opposite edges of said chute at the end thereof adapted to be disposed adjacent said fixing section being turned downwardly to prevent the middle portion of the sheet being conveyed through the fixing section from floating off the surface of said chute.

2. A copy sheet conveying device as set forth in claim 1 wherein the end edge portion of said chute intermediate said downwardly turned edges is provided with a downwardly extending reversely bent portion to provide a smooth end edge.

* * * * *